US006463780B1

(12) United States Patent
Kalanish

(10) Patent No.: US 6,463,780 B1
(45) Date of Patent: Oct. 15, 2002

(54) TUBE BENDER AND PROCESS

(75) Inventor: Scott S. Kalanish, Hiram, OH (US)

(73) Assignee: Stride Tool, Inc., Ellicottville, NY (US)

( * ) Notice: Subject to any disclaimer, the term of this patent is extended or adjusted under 35 U.S.C. 154(b) by 0 days.

(21) Appl. No.: 09/972,535

(22) Filed: Oct. 8, 2001

(51) Int. Cl.[7] ..... B21D 11/04; B21D 7/02
(52) U.S. Cl. ..... 72/388; 72/217; 72/459
(58) Field of Search ..... 72/458, 388, 459, 72/451, 216, 217, 149, 154, 319, 387

(56) References Cited

U.S. PATENT DOCUMENTS 1,075,837 A * 10/1913 Malo et al. ..... 72/459
2,979,976 A * 4/1961 Franck ..... 72/388
3,190,105 A * 6/1965 Strybel ..... 72/217
4,379,399 A 4/1983 Kowal
4,379,400 A 4/1983 Schwarz
4,380,922 A 4/1983 Kowal
4,389,872 A 6/1983 Kowal
4,389,873 A 6/1983 Schwarz et al.
4,403,496 A 9/1983 Kowal
4,424,699 A 1/1984 Peppers
4,827,755 A * 5/1989 Strybel ..... 72/388

* cited by examiner

*Primary Examiner*—David Jones
(74) *Attorney, Agent, or Firm*—Benesch, Friedlander, Coplan & Aronoff, LLP

(57) ABSTRACT

A tube bender including a mandrel component having an arcuately curved recess of at least 180 degrees is disclosed. An anchor connected to the mandrel for securing a tube in the recess. A tube former is rotatably connected to the mandrel. The former has a tube engaging surface for engaging a surface of a tube disposed in and in engagement with the recess. The former and recess are positioned to engage opposite sides of a positioned tube. The mandrel and former are relatively rotatable about an axis that is coaxial with a groove axis. A mandrel handle is connected to the mandrel and a tube former handle is connected to the former. The former handle is rotatable between 90 degree and 180 degree bend positions relative to the former selectively to provide good leverage for 90 degree bends and over 90 degree bends.

12 Claims, 4 Drawing Sheets

TUBE BENDER AND PROCESS

FIELD OF THE INVENTION

This invention relates to tube bending tools and more particularly to manually operable tube benders especially suited for effecting bends of in excess of 90 degrees.

BACKGROUND OF THE INVENTION

Manually operated tools for bending tubing are quite old and well known in the art. For example, such tools are widely used by electricians for forming bends in an electrical conduit. Examples of commercial tube benders sold by Stride Tool Inc. and its predecessors are described and claimed in U.S. Pat. Nos. 4,379,399, 4,380,922, 4,289,872, 4,389,873, 4,403,496, 4,379,400, and 4,424,699 (herein the Stride Patents). With the tools of the Stride Patents bends up to 180 degrees may be accomplished. While the tools have enjoyed longstanding commercial success, the tools are somewhat awkward for use in effecting bends in excess of 90 degrees because the handles which are manipulated by an operator to effect the bend cross over when a tube is being bent beyond 90 degrees. When the handles cross over manipulation becomes somewhat awkward and difficult. Moreover, an operator in bringing his hands toward one another through the first 90 degrees while after the cross over an operator's force application is reversed and one is pulling one's hands apart or pressing with crossed arms.

Another tool that has been available commercially for a period of time requires disconnection of one of the handles after a 90 degree bend has been completed by unscrewing the handle from the tool element to which it is connected. The handle is then reconnected by threading it into other threaded recess to effect bending from 90 degrees up to 180 degrees. With at least one other commercially available tool there is no provision for bending beyond 90 degrees.

Accordingly it would be desirable to produce a manually operated tube bender which is capable of effecting bends up to 180 degrees without handle cross over or the need to disconnect and reconnect one of the handles after 90 degrees of bending has been accomplished.

SUMMARY OF THE INVENTION

With the tool of the present invention, a mandrel corresponding to the mandrel described and claimed in the Stride Patents is provided. The mandrel has a tube engaging recess which has an arcuate configuration in cross section and itself is a semi circle in its other plane of cross section to provide tube support for bending up to 180 degrees. A link is connected to the mandrel for rotation about the mandrel axis. A forming member is pivotally connected to the link in spaced relationship with the mandrel axis such that forming rollers carried by the forming member engage a tubular work piece mounted in engagement with the mandrel and held in place by a hook retainer. A pair of manually operated handles are respectively connected to the mandrel and the forming member for manipulative application of forces to a tubular work piece to bend the work piece.

With the tool of the present invention the forming member handle includes an obtuse bend such that gripping portions of the handles are located in a manner which facilitates effecting the first 90 degrees of bending. If a work piece is to be bent in excess of 90 degrees the forming member handle is rotated relative to its mounting in the forming member to relatively reposition the handles until gripping portions of the handles are appropriately located for facilitating further bending of the tube beyond 90 degrees.

A latching mechanism is provided to fix the handle selectively and one at a time in its under 90 and over 90 degree bending positions. The latching mechanism in the preferred and disclosed arrangement is a spring biased, reciprocal rod which is axially shiftable between handle lock and handle release positions. The latching mechanism retains a handle in its under 90 or over 90 bending positions selectively and one at a time or alternately permits ready rotation of the forming member handle relative to the forming member.

Accordingly the objects of the invention are to provide a novel and improved tube bender and a method of bending tubes.

DETAILED DESCRIPTION OF THE DRAWINGS

Figure 9:
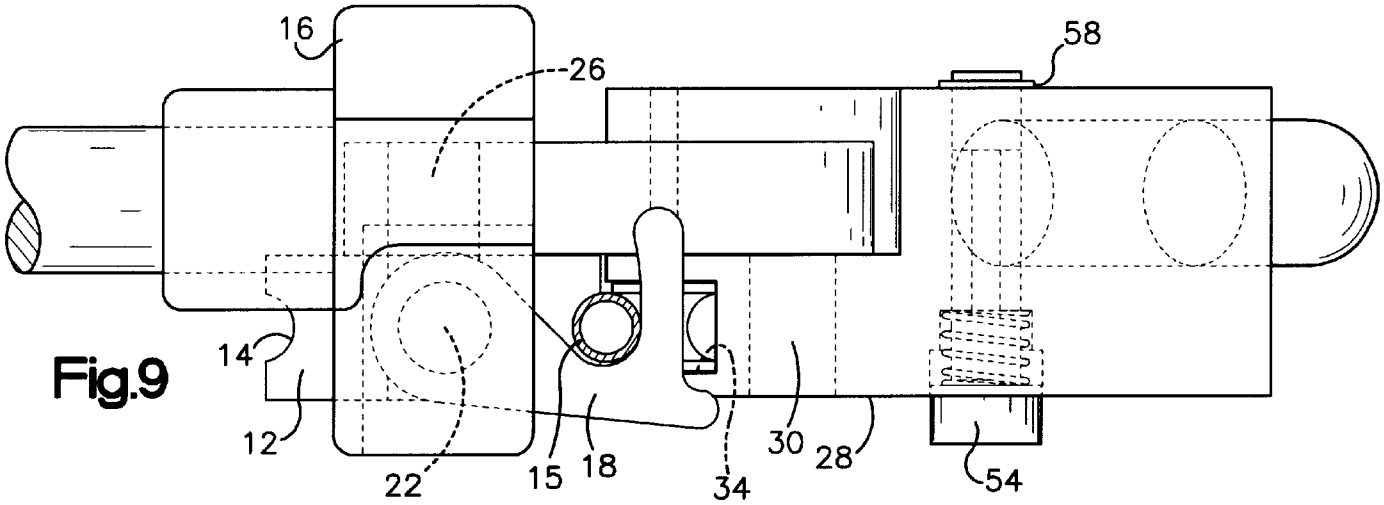
Figure 10:
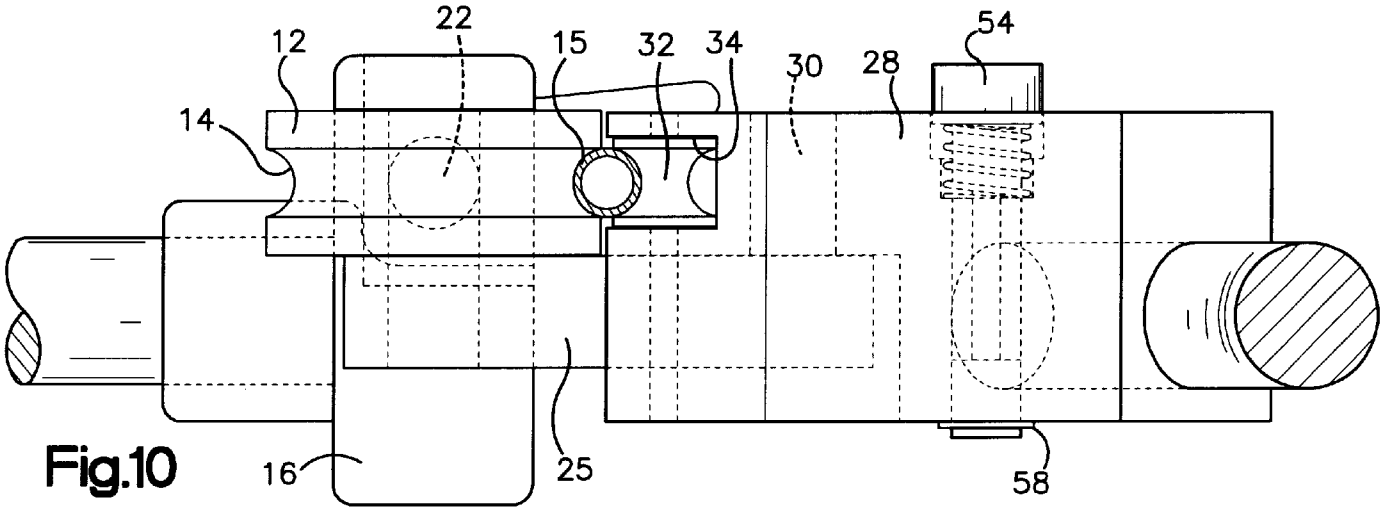

Referring to the drawings a tube bender is shown generally at 10. The bender includes a mandrel 12 having an arcuately curved groove 14 of at least 180 degree extent. As may be seen by an examination of FIGS. 9 and 10 the groove 14 is arcuate in cross section. In use a work piece 15 in the form of a tube, such as a section of electrical conduit, is laid across the top of the tool and extends into the groove 14 to engage it its base.

Figure 1:
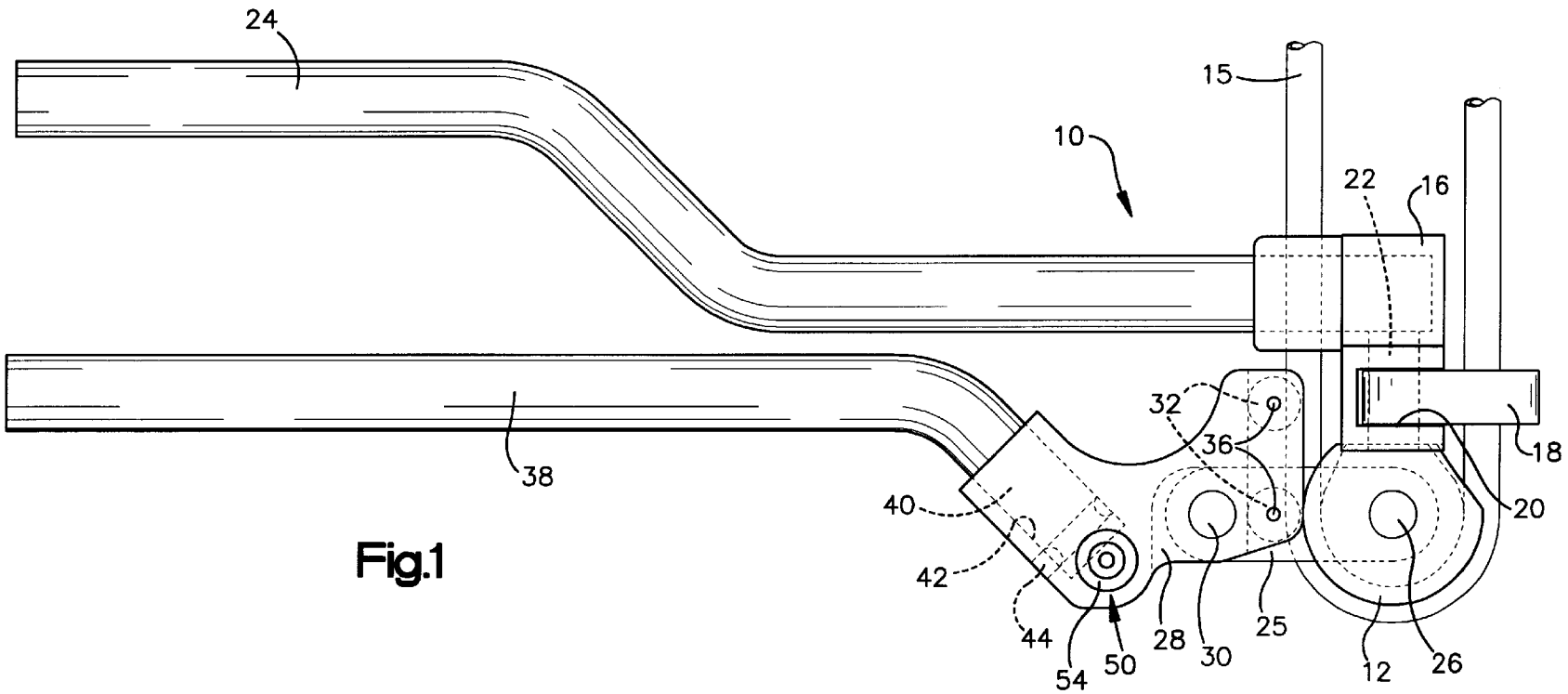
FIG. 1 is an elevational view of the tube bender at the completion of a 180 degree bend.

An anchor arm 16 is connected to the mandrel 12 projecting to the left as seen in FIG. 1. A work piece anchoring hook 18 is mounted in a recess 20 in the anchor arm 16. A pivot pin 22 rotatably supports the anchor hook 18 in the groove 20. A mandrel handle 24 is fixedly connected to the anchor arm 16 and thence to the mandrel 12.

A tube former link 25 is mounted on a former pin 26. The pin 26 is coaxial with the base of the groove 14 such that the link 25 is rotatable about the groove axis. A tube former 28 is pivotally connected to the link 25 by a former pivot pin 30. The tube former 28 is rotatable both about the coaxial axes of the groove 14 and the pivot pin 26 and about a spaced and parallel axis of the former pivot pin 30. A pair of former rolls 32 are rotatably mounted in a groove 34 of the tube former 28. The former rollers 32 are mounted in spaced relationship by pins 36 which extend through sections of the former on opposite sides of the groove 34.

Figure 7:
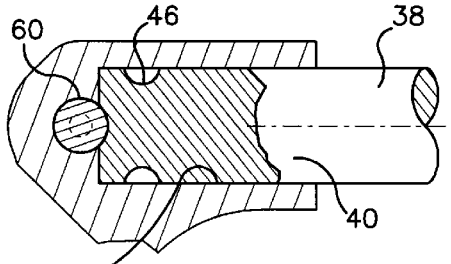

A former handle 38 is provided. The former handle has an end portion 40 rotatably mounted in a bore 42 in the tube former 36. A set screw 44 is threaded into the tube former 28 to project into the bore 42. The set screw 44 also projects into a retaining groove 46 in the end portion 40, FIG. 7. Thus the set screw cooperates with the retaining groove to maintain the end portion 40 in the bore 42 while permitting rotation of the handle 38 relative to the former 28.

A position retention groove 48 is formed at the inner end of the end portion 40. A handle lock member 50 is reciprocatively mounted in the tube former 28. The lock member has an axis which is normal to the axis of the end portion 40. In the preferred embodiment the lock member and the end portion axes intersect. A lock spring 52 is interposed between the tube former 28 and a head 54 of the lock member 50. As will be seen from FIG. 8 the spring 52 surrounds a cylindrical head portion 56 of the lock member 50.

Figure 6:
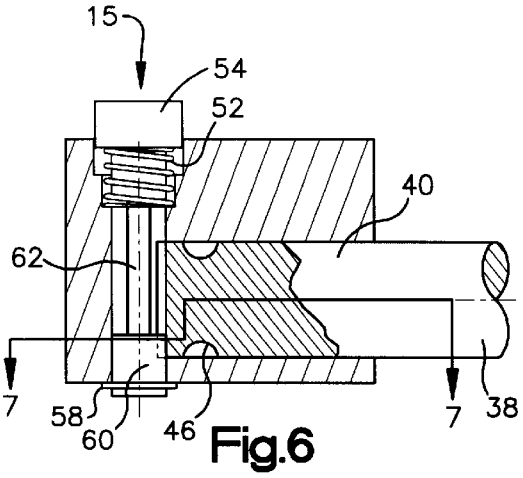
FIGS. 6–8 are enlarged sectional views depicting the former handle and its movement from one operative position to the other; and, FIGS. 9 and 10 are enlarged, fragmentary plan views of the tool respectively as seen from the planes indicated by the lines 9—9 and 10—10 of FIG. 5.
Figure 8:
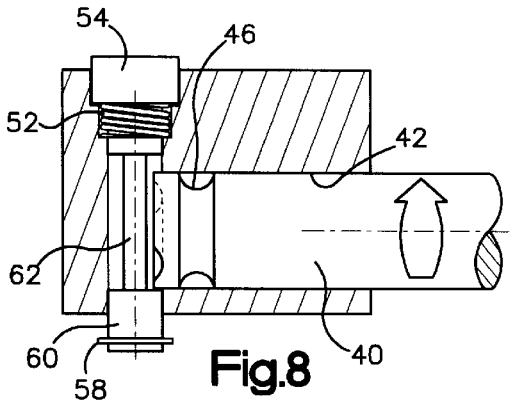

A snap ring 58 is disposed in a ring groove formed in the lock member near an end remote from the head 54, FIG. 6 and 8. The snap ring 58 retains the lock member 50 in a bore in the tube former 28 against the action of the spring 52.

Figure 2:
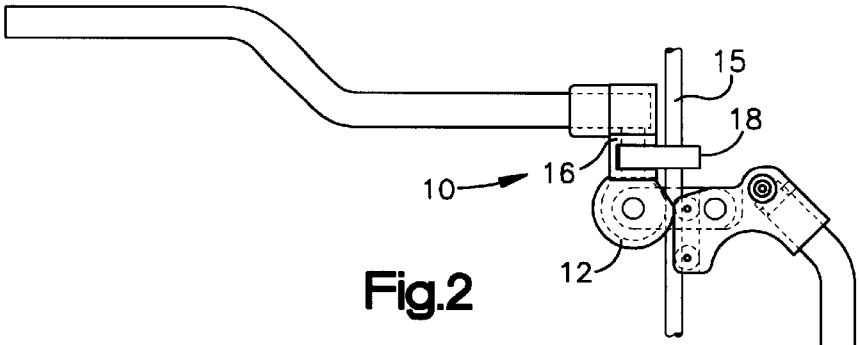
FIGS. 2–4 are sequential views showing the formation of a 180 degree bend.
Figure 4:
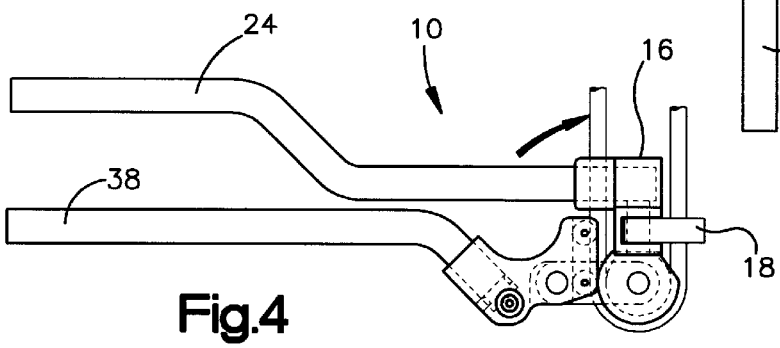
Figure 5:
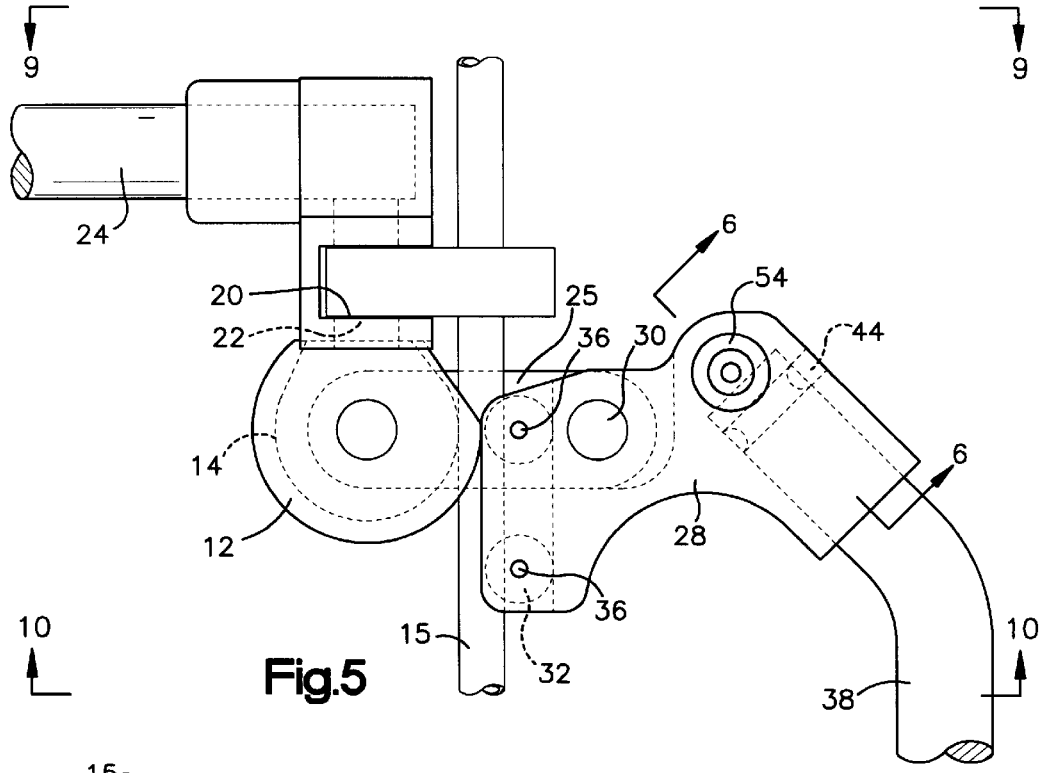
FIG. 5 is an enlarged fragmentary view of the tool positioned to commence a bending operation.

When the lock member 50 is in its normal or lock position, a lock section 60 of the lock member engages the position retention groove 48 to maintain the former handle 38 in either of its two operating positions. These operating positions are a 0 to 90 degree bend position as shown in FIG. 2 and a 90 to 180 degree position as shown in FIG. 4. When it is desired to move the former handle 38 from one of its position to the other an operator simply depresses the lock member 50 against the action of the spring 52 to bring a reduced diameter central portion 62 of the lock member 50 into axial alignment with the position retention groove 38. When the groove 48 and the central portion 62 are aligned the end portion 40 of the handle 38 is freely rotatable in the bore 42.

Operation

The former handle 38 is positioned in its 0 to 90 bend position. The link 25 and the former 28 and the former handle 38 are swung about the axis of the pin 26 to position them as shown in FIG. 2. A tube 15 to be bent is positioned adjacent the anchor arm 16 with an end portion extending into and beyond the groove 14. The hook 18 is swung to the position of FIG. 2 to retain the work piece in position. The former handle 38 is now manipulated to bring the former rollers 32 into engagement with the work piece 15 along a surface portion opposite the portion engaging the groove 14. Forces manually applied to the handles shift them relatively from the position of FIG. 2 to the position of FIG. 3 thus effecting a 90 degree bend.

Where it is desired to extend the bend beyond 90 degrees the head 54 of the lock member 50 is pressed to compress the spring 52 and shift the lock section 60 out of engagement with the retention groove 48. The handle is then rotated to shift it from the position of FIG. 7 to the position of FIG. 4. Once in the position of FIG. 4 the spring 52 will shift the lock member 50 axially to bring the lock section into engagement with the groove 48 and thus lock the former handle in its 90 to 180 degree position.

Figure 3:
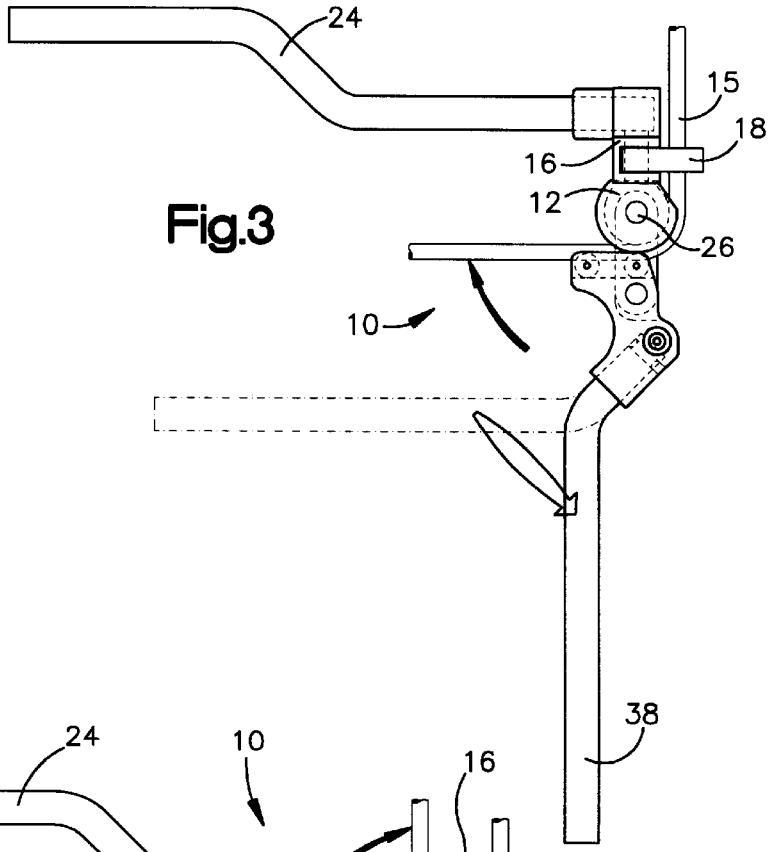

The operator once again grasps both handles and applies force to them to shift the handles from the position of FIG. 3 toward one another and effect a further bend beyond 90 degrees and up to 180 degree as shown in FIGS. 1 and 4.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed:

1. In a tube bender having a pair of handles for receiving manually applied forces to bend a tube, an improved handle mounting comprising;

a) a body having a generally cylindrical handle mounting recess;

b) a handle having an end portion disposed in the recess and being rotatable about an end portion axis;

c) a locator carried by the body and moveable between lock and release positions;

d) the locator being coactable with the handle to prevent relative rotation of the handle and the body when in the lock position; and, e) the handle and body being relatively rotatable when the locator is in the release position.

2. The mounting of claim 1 wherein the locator is an axially moveable pin having a lock surface for rotation preventing engagement with the handle.

3. A process of bending tubular items comprising;

a) positioning a tube in engagement with a circumferential arcuately curved mandrel groove having a curved cross section;

b) positioning an anchor to maintain the tube in position relative to the groove;

c) engaging a tube former with, a surface of the tube opposite the groove;

d) relatively moving a pair of handles respectively connected to the mandrel and the former to form a first bend of a given angle in the tube;

e) relatively repositioning the handles from the given angle position to a further angel position while maintaining their respective connections to the mandrel and the former to reposition the handles in a relative position of enhanced leverage for further bending of the tube;

f) the handle repositioning being accomplished by rotating the handle connected to the former about an axis of an end position of the handle connect to the former relative to the former while maintaining the handle to former connection;

g) manipulating a releasable lock to effect the relative handle positioning and to maintain the handle connected to the former selectively and one at a time in the given angle and the further angle positions; and, h) applying force to the repositioned handles to further bend the tube to an angle greater than the given angle.

4. The process of claim 3 wherein the given angle is about 90 degree and the further angle is from 90 degrees up to about 180 degrees.

5. The process of claim 4 wherein the handle repositioning is accomplished by rotating the handle connected to the former relative to the former while maintaining the handle to former connection.

6. The process of claim 5 where in a releasable lock maintains the handle connected to the former selectively and one at a time in the given angle and the further angle positions and is releasable to permit the relative positioning.

7. The process of claim 3 wherein the handle repositioning is accomplished by rotating the handle connected to the former relative to the former while maintaining the handle to former connection.

8. The process of claim 7, where in a releasable lock maintains the handle connected to the former selectively and one at a time in their given angle and the further angle positions and is releasable to permit the relative positioning.

9. In a tube bender having a mandrel and a tube former components pivotally connected together and mandrel and former handles respectively connected to the mandrel and former components, an improved handle to component connection comprising;

a) one of the components including a handle receiving bore;

b) the handle connected to the one component including an end portion rotatively disposed in the bore for rotation about an end portion axis;

c) the one component and the end portion including coacting surfaces permitting relative rotation while limiting relative axial movement;

d) the end portion also including a locking surface; and, e) a lock member moveably carried by the one component and moveable between a lock position engaging the locking surface to prevent such relative rotation and a release position permitting such relative rotation.

10. The connection of claim 9 wherein the one component is the former component.

11. The connection of claim 10 wherein the lock member is an axially moveable spring biased member of circular cross section having a locking section engageable with the locking surface when the member is in the lock position and a reduced diameter section axially aligned with the locking surface when the member is in the release position.

12. The connection of claim 9 wherein the lock member is an axially moveable spring biased member of circular cross section having a locking section engageable with the locking surface when the member is in the lock position and a reduced diameter section axially aligned with the locking surface when the member is in the release position.

* * * * *